United States Patent [19]

Plumat et al.

[11] Patent Number: 4,560,591

[45] Date of Patent: Dec. 24, 1985

[54] APPARATUS FOR AND METHOD OF SPRAYING FOR FORMING REFRACTORIES

[75] Inventors: Robert Plumat, Mons; Pierre Robyn, Nivelles; Pierre Deschepper, Charleroi, all of Belgium

[73] Assignee: Glaverbel, Brussels, Belgium

[21] Appl. No.: 630,395

[22] Filed: Jul. 13, 1984

[30] Foreign Application Priority Data

Jul. 30, 1983 [GB] United Kingdom ..... 8320631

[51] Int. Cl.[4] ..... B05D 1/12

[52] U.S. Cl. ..... 427/422; 427/427; 118/317; 239/85; 239/553

[58] Field of Search ..... 118/317; 239/226, 227, 239/85, 553, 590, 558, 566, 132.3; 427/427, 422

[56] References Cited

U.S. PATENT DOCUMENTS

| | | | |
|---|---|---|---|
| 3,472,201 | 10/1969 | Quackenbush | 118/317 |
| 3,800,983 | 4/1974 | Brichard et al. | 222/52 |
| 3,902,669 | 9/1975 | Keibler | 239/227 |
| 4,211,367 | 7/1980 | Allison | 239/227 X |

*Primary Examiner*—Shrive P. Beck

*Attorney, Agent, or Firm*—Spencer & Frank

[57] ABSTRACT

A lance for spraying particulate refractory-forming combustible material, particulate refractory material and a comburent gas is characterized in that the lance 1 comprises at least one feed passage 2,3 for conveying material to be sprayed to a lance head 4 which comprises a plurality of spray nozzles 5 for spraying such material, and in that the flow path of the material being sprayed branches or turns a corner and a cup-like recess 7,9 is located at the or each such branch or corner, open to the flow path upstream thereof, for catching particulate material conveyed along said flow path so that the material caught itself forms a barrier against abrasion at the location of such recess.

A method of using such a lance to spray particulate refractory-forming combustible material, particulate refractory material and a comburent gas against a surface so that on combustion a coherent refractory mass is formed on such surface is also disclosed.

24 Claims, 10 Drawing Figures

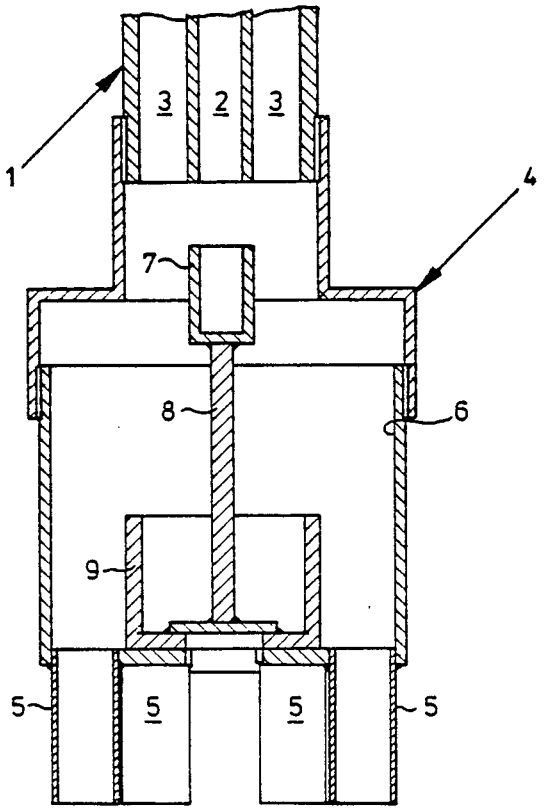
FIG. 1
FIG. 2
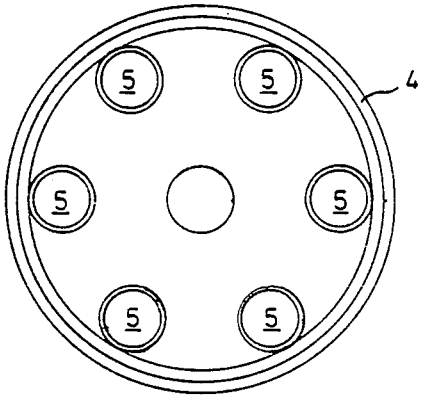

APPARATUS FOR AND METHOD OF SPRAYING FOR FORMING REFRACTORIES

BACKGROUND OF THE INVENTION

The present invention relates to a lance for spraying particulate refractory-forming combustible material, particulate refractory material and a comburent gas. The invention extends to apparatus including such a lance and also to a method of spraying using such a lance.

Such lances are useful inter alia in performing spraying processes for forming refractory masses in situ for example using apparatus described in British Patent Specification No. 1330895 and counterpart U.S. Pat. No. 3,800,983.

In such processes, a mixture of refractory-forming particles and refractory particles is projected against a surface in a gas stream containing oxygen. Examples of refractory materials cited are particles of silica, alumina, zircon, zirconia and magnesia, and mixtures of two or more of these materials. Examples of refractory-forming materials are particles of silicon, aluminium, zirconium and magnesium, and mixtures of two or more of these materials. The refractory-forming particles react exothermically in the presence of oxygen to form a corresponding refractory material and to evolve heat to melt at least the surfaces of the refractory particles they are sprayed with, so that a coherent refractory mass is formed.

Such processes are particularly suitable for the hot repair of furnaces and other refractory devices and are especially advantageous where hot rebricking presents significant problems. It will be appreciated however that it is desirable that any such repair should be completed as rapidly as possible so that the down-time of the plant being repaired is minimized. It has been found when using known equipment for flame spraying to form a refractory mass that the rate at which a coherent mass of satisfactory quality can be built up is limited. This is especially disadvantageous when a large repair volume is required.

SUMMARY OF THE INVENTION

It is an object of the present invention to provide apparatus which enables such a refractory mass to be formed more rapidly.

According to the present invention, there is provided a lance for spraying particulate refractory-forming combustible material, particulate refactory material and a comburent gas characterised in that said lance comprises at least one feed passage for conveying material to be sprayed to a lance head which comprises a plurality of spray nozzles for spraying such material, and in that the flow path of the material being sprayed branches or turns a corner and a cup-like recess is located at the or each such branch or corner, open to the flow path upstream thereof, for catching particulate material conveyed along said flow path so that the material caught itself forms a barrier against abrasion at the location of such recess.

The invention extends to a method of spraying particulate refractory-forming combustible material, particulate refactory material and a comburent gas against a surface so that on combustion a coherent refractory mass is formed on such surface, characterised in that spraying is effected using a lance having at least one feed passage along which the material to be sprayed is conveyed to a lance head whence the material is ejected through a plurality of spray nozzles and in that the flow path of the material being sprayed branches or turns a corner and a cup-like recess is located at the or each such branch or corner, open to the flow path upstream thereof, for catching particulate material conveyed along said flow path so that the material caught itself forms a barrier against abrasion at the location of such recess.

Hitherto such lance heads as have generally been used have had a single nozzle for the ejection of the sprayed material. For a given size of nozzle orifice, there is a maximum rate at which sprayed material can be ejected, and accordingly a maximum rate of build up of the refractory mass formed by spraying. It would of course be possible to increase the ejection rate of the sprayed material by using a larger nozzle. However if the spray nozzle orifice is increased in size beyond a practical limit, it has been found that the ejected material no longer forms a well defined stream, the resulting refractory mass is of inferior quality, the yield of the reaction can be reduced and indeed the reaction can be halted.

We have found that by using a plurality of spray nozzles, the sprayed material can be ejected in neighbouring well defined streams so that a high quality coherent refractory mass can be formed more rapidly than hitherto.

However unless the multi-nozzled lance is merely a bundle of straight lances, it will be appreciated that the flow path of the material being sprayed must branch or turn a corner, and accordingly, the particulate material being sprayed will be caused to impinge against the wall of the flow passage at that location. That examples of refractory materials to be sprayed through lances according to this invention are particles of silica, alumina, zircon, zirconia and magnesia, has previously been mentioned. It is well known that these materials are highly abrasive, and indeed sand-blasting techniques for abrading surfaces are of general knowledge. It will be apparent therefore that there would be a very high risk of abrasion at any such branch or corner in the flow path of the material being sprayed. It has been found that by locating a cup-like recess at such branch or corner, this risk can be very greatly reduced, because material caught in such recess will itself form a barrier against abrasion of the passage wall at that location.

In some preferred emobidments of the invention, there is at least one feed passage feeding all said spray nozzles. This simplifies construction of the lance.

In other preferred embodiments of the invention, said lance comprises a plurality of feed passages each feeding a said spray nozzle. The adoption of this feature presents advantages in cooling of the feed passages as will be adverted to hereinafter.

Advantageously, said spray nozzles are disposed out of register with the or a said feed passage and the lance head includes a cup member in line with and open to such feed passage. The adoption of this feature has the advantage of permitting particulate material to be sprayed over a greater area than would otherwise be possible.

Advantageously, said lance head includes said spray nozzles whose ends are differentially spaced from the centre of the lance head. When the sprayed material is ejected from nozzles whose ends are differentially spaced from the centre of the lance head, it is possible to spray material over a relatively large area of the surface to be repaired while ensuring that the trajectories of the different spray streams are of substantially the same length. This contributes to the formation of a coherent refractory mass of uniform quality.

Preferably, the nozzles have substantially parallel axes. Spraying the material in streams which have substantially parallel axes gives advantages in the way heat evolved during combustion is concentrated and in the way in which the sprayed material goes to form a coherent refractory mass.

In some preferred embodiments of the invention, the spray nozzles are disposed with their axes at an angle to the axis of the lance. For example such axes may lie at a right angle to the axis of the lance. Such embodiments are useful in circumstances where a repair is to be effected in a refractory chamber having a dimension less than the length of the lance, for example in the repair of the interior of a flue.

Preferably, the lance head is symmetrical about an axis through its centre, so that the sprayed material is ejected from the lance head in streams which have a common axis of symmetry.

In the most preferred embodiments of the invention, the lance stem is provided with a cooling jacket and the lance is cooled during spraying. This reduces the risk of flashback, and it also reduces any risk that the particulate material being sprayed should become molten or softened while still in the lance to such an extent that it clogs the lance head.

Such a cooling jacket is preferably a contra-flow cooling jacket, and it preferably comprises at least three concentric coolant pasages arranged for coolant flow in alternate directions as between one such passage and the next.

The lance head preferably includes at least three spray nozzles.

The present invention extends to spraying apparatus including a lance as herein defined and means for feeding particulate material thereto via a venturi for the or each feed passage along which particulate material is to be conveyed. The use of a venturi in this way avoids any need to pressurize a reservoir of the particulate material with the carrier gas used for conveying it along the or a feed passage, and has the further advantage that at the exit from such reservoir, it can be arranged that the particulate material is under sub-atmospheric pressure. This is important from the safety point of view in case flashback should occur.

Preferably, there is a single hopper for feeding particulate material to the or each feed passage, so that said combustible material and said refractory material are fed to the lance from a common hopper. This simplifies the apparatus required.

For reasons of safety, it is preferred that said refractory particles constitute at least 80% by weight of the particulate material sprayed.

BRIEF DESCRIPTION OF THE DRAWINGS

FIG. 1 is a sectional view of a lance head at the distal end of a lance,

FIG. 2 is an end elevation of the lance head of FIG. 1,

DESCRIPTION OF THE PREFERRED EMBODIMENTS

Figure 3A:
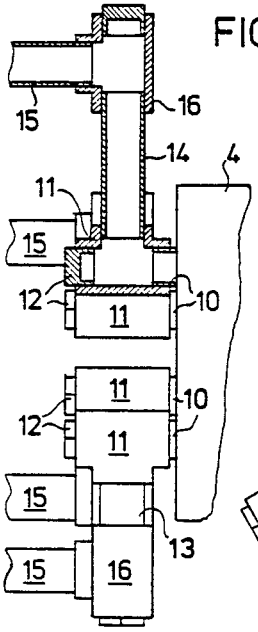
FIGS. 3A and 3B are respectively side and end elevations of a second lance head.

In FIG. 1, a lance 1 for spraying particulate refractory-forming combustible material, particulate refractory material and a comburent gas comprises two feed passages 2, 3 for conveying material to be sprayed to a lance head generally indicated at 4. The lance head 4 comprises a plurality of spray nozzles 5 for spraying such material. In fact the lance head has six such nozzles as shown in FIG. 2.

In the spraying of particulate refractory-forming combustible material, particulate refractory material and a comburent gas, it has been found that in order to form a refractory mass of high quality, it is necessary for combustion of the refractory-forming material to proceed smoothly and regularly. We have found that the use of a nozzle constituted by a single wide bore militates against this desideratum, because of turbulence which arises at a boundary region between the spray jet and the ambient atmosphere.

In the arrangement shown, each of the feed passages 2, 3 feeds all the nozzles 5 via a mixing chamber 6 in the lance head 4.

The spray nozzles 5 are disposed out of register with the feed passages 2, 3 so that the flow path of the sprayed material branches and accordingly undergoes a change of direction within the lance head. In accordance with an important feature of this invention, the lance head 4 includes a cup-like recess in this embodiment formed by a cup member 7 in line with and open to one of the feed passages, in this case the first feed passage 2. The cup member 7 is mounted on the end of a column 8 which is concentric with a second cup member 9 in line with and open to the other feed passage indicated at 3. The effect of this is that when particulate material is first fed to the lance head 4 along one or both of the feed passages 2 and 3, such material will collect in the respective cup or cups in line with the feed passage(s), so that further material will impact directly on previously collected material and not directly on any part of the lance head 4. The collected material forms an extremely efficacious barrier against abrasion of the lance head by the particulate material being sprayed.

The lance 1 is provided with two feed passages 2, 3 so that the combustible refractory-forming material may be conveyed to the lance head separately from part of the comburent gas as a safety measure, in order to reduce the risk of flashback as much as possible. In a typical process, the particulate material sprayed comprises up to 20% by weight combustible refractory forming material such as silicon and/or aluminium, the balance being refractory particles. In such a case, the combustible particles could be conveyed along the first, central feed passage 2 using a mixture of nitrogen and oxygen, such as air, as carrier gas, while the refractory particles are conveyed along the second outer feed passage 3 using oxygen as carrier gas. In an alternative arrangement which is equally advantageous from the safety point of view, all the particles could be conveyed as a mixture along the outer feed passage 3 in a mixture of nitrogen and oxygen, while the balance of the required oxygen is fed along the central feed passage 2.

In the embodiment of lance head illustrated in FIGS. 1 and 2, as will be more clearly seen from FIG. 2, the six spray nozzles 5 are arranged in a regular hexagon whose centre is on the axis of the lance and its head.

The embodiment of lance head shown in FIGS. 1 and 2 is specifically designed for forming, at a high rate, a refractory mass which is concentrated in a small area.

Figure 3B:
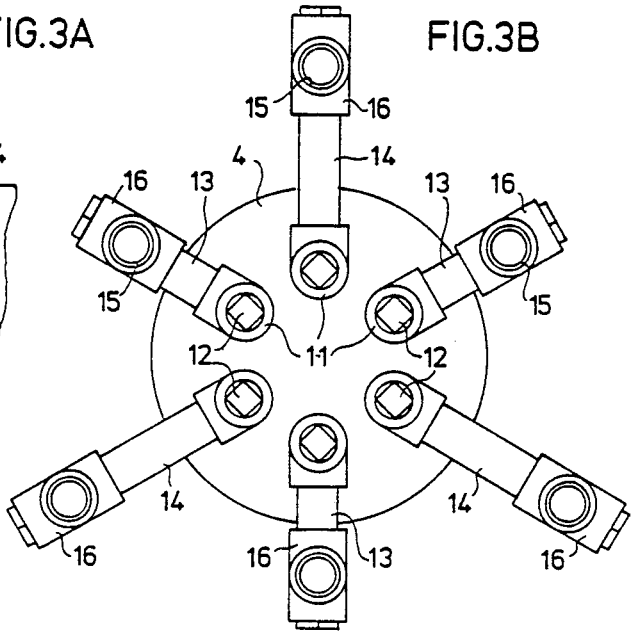

FIGS. 3A and 3B illustrate a modified lance head for spraying material over a greater area.

In FIGS. 3A and 3B, six tubes 10 project from the lance head 4 in place of the nozzles 5 of FIG. 1. A T pipe connector 11 is attached to each of these tubes 10 by one end of its horizontal arm, so that the vertical arm of the T projects radially outwards from the centre of the face of the lance head. The other end of the horizontal arm of the T connector is closed by a plug 12 in such a way that a blind cavity is left in that branch of the horizontal arm. In use, that cavity will be filled with particulate material which will serve to protect the plug 12 from erosion by sprayed material in the same way as the end face of the lance head is protected by the cup members 7 and 9 shown in FIG. 1. Into the vertical arms of alternate T connectors are screwed respectively short radius pipes 13 and longer radius pipes 14. A nozzle 15 is attached to the end of each radius pipe 13, 14 by a T connector 16 in the same way as the radius pipes are connected to the tubes 10.

This arrangement enables material to be sprayed in the direction of the axis of the lance over a greater area than the arrangement shown in FIGS. 1 and 2.

Figure 4A:
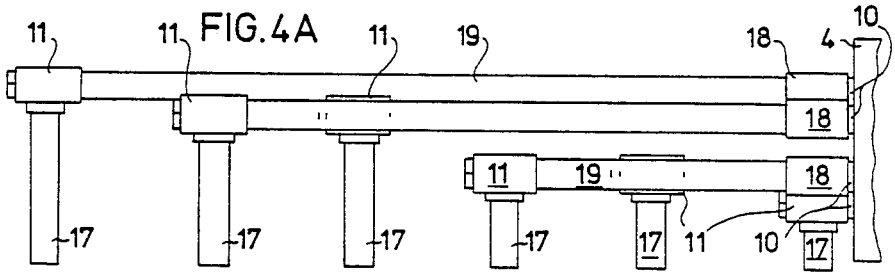
FIGS. 4A and 4B are respectively side and plan views of a third lance head.
Figure 4B:
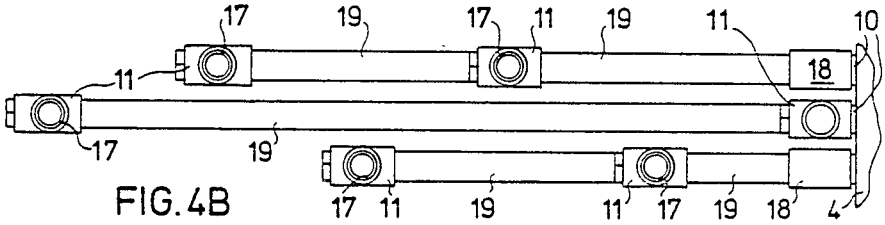

It is sometimes desirable for material to be sprayed from nozzles which are disposed with their axes at an angle to the axis of the lance, for example for the repair of flues or other narrow passages. A lance head designed for this purpose is shown in FIGS. 4A and 4B. In those Figures, a lance head, again indicated at 4, is provided with a crown of six ejector tubes 10. A T connector 11 is fitted to one of those tubes 10 in the same way as was described with reference to FIGS. 3A and 3B, and that connector in turn carries a spray nozzle indicated at 17. The other ejector tubes 10 carry straight pipe connectors 18 to which are attached extension tubes 19 of various lengths. A further spray nozzle 17 is attached to the end of each extension tube 19 by a T connector 11, again in the same way as the radius pipes 13, 14 of FIGS. 3A and 3B were connected to the tubes 10.

Figure 5:
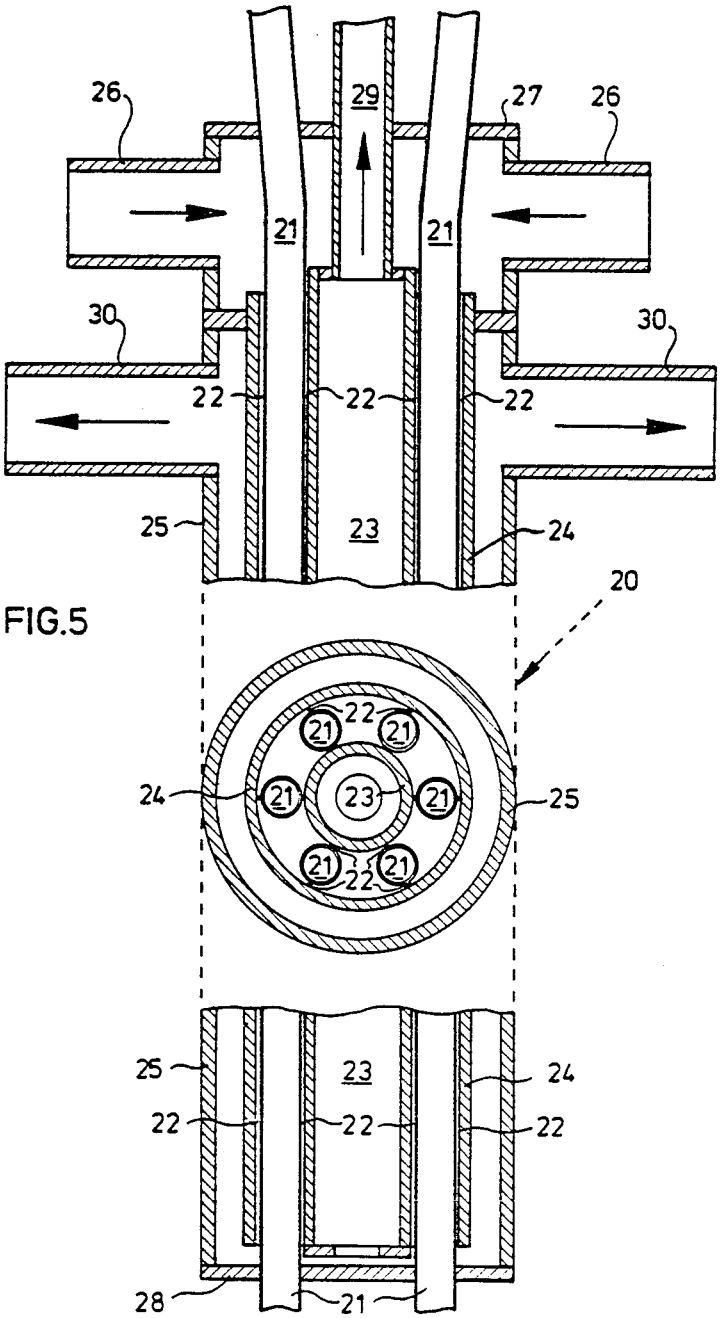
FIG. 5 is a sectional view of a second lance.

FIG. 5 shows a modified form of lance 20 in longitudinal and cross-sections. The lance 20 comprises a regular hexagonal array of six feed passages 21 held by fins 22 between two concentric pipes 23,24. A third pipe 25 surrounds and is concentric with the two concentric pipes 23,24, and together with those pipes forms a cooling jacket surrounding the array of feed passages 21. A coolant inlet manifold 26 is provided at the proximal end 27 of the lance 20 arranged to communicate with the space between the first two concentric pipes 23,24 so that coolant, for example water can flow in direct contact with the feed passages 21 from the proximal end 27 of the lance to its distal or head end 28. The arrangement at the head end 28 of the lance is such that the coolant can return to the proximal end in contra-flow inside the inner concentric pipe 23, to a central coolant outlet 29, and between the two outer concentric pipes 24,25, to an outlet manifold 30. The head ends of the feed passages 21 may be provided with spray nozzles as described with reference to FIG. 3 or 4.

Figure 6:
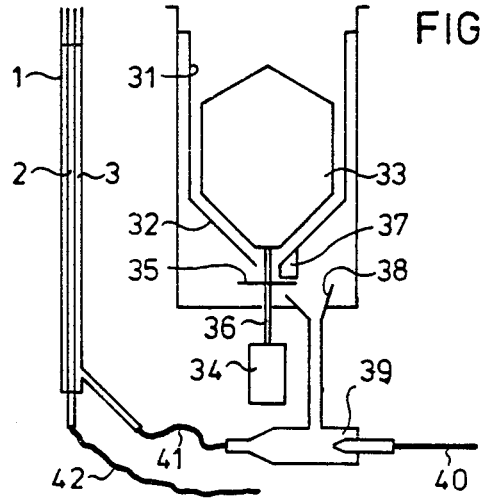
FIGS. 6, 7 and 8 show arrangements for feeding a lance with material to be sprayed.

FIG. 6 shows an arrangement for feeding particulate material to be sprayed to a lance, for example the lance 1 illustrated in FIG. 1. The desired mixture of material to be sprayed is placed in a single hopper 31 having an open conical base 32 and containing a paddle 33 rotatable by a motor 34. A plate 35 is carried by the motor drive shaft 36 beneath the opening at the base 32 of the hopper, and a doctor 37 is provided on the outside of the hopper base for scraping material from that plate so that it will fall into a chute 38 leading to a venturi 39. Gas is fed along a line 40 to the venturi 39 to draw particulate material to be sprayed into a flexible feed line 41 leading from the venturi 39 to the lance 1 where that material passes into the outer feed passage 3 (FIG. 1). A second flexible line 42 is provided for feeding oxygen to the central feed passage 2 of the lance 1. If sufficient oxygen for efficient combustion can be fed along the second flexible line 42 and the central feed passage 2 of the lance, the particulate material may be entrained at the venturi 39 in a mixture of nitrogen and oxygen, such as air.

Figure 7:
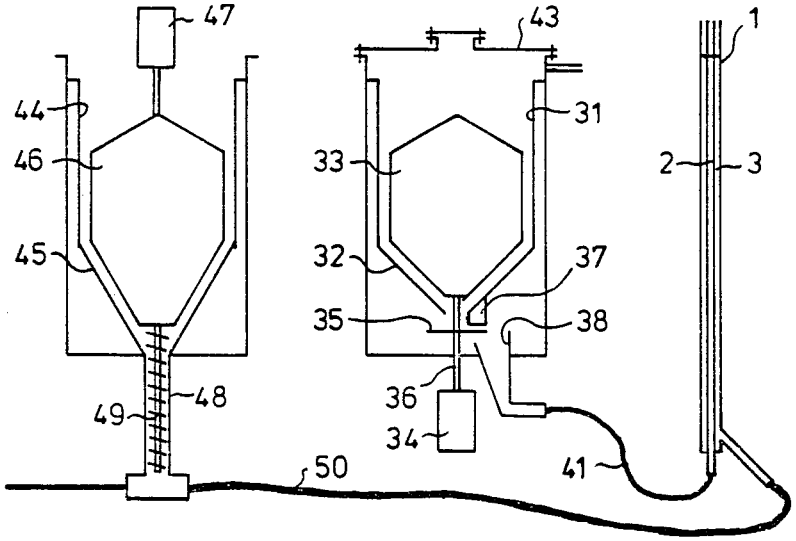

FIG. 7 illustrates an arrangement in which the refractory-forming material and the refractory material to be sprayed are fed to the lance separately. Refractory forming material, for example aluminium and/or silicon particles, is contained in a hopper similar to that shown in FIG. 6, but which is provided with a lid 43 and which is pressurizable with air or other nitrogen-oxygen mixture for carrying the combustible material from spout 38 to a flexible line 41 feeding the central feed passage 2 of the lance 1. Of course, if it should be desired, this pressurized feed system could be replaced by a venturi feed system as described with reference to FIG. 6. Refractory material is held in a second hopper 44 having a conical base 45 and containing a paddle 46 rotatable by a motor 47. The conical base 45 of the hopper terminates in a feed pipe 48 containing a worm 49 which serves to inject the material into an oxygen stream feeding the outer feed passage 3 of the lance 1 via a flexible line 50. Again, such a worm feed could be replaced by a venturi feed as described with reference to FIG. 6.

Figure 8:
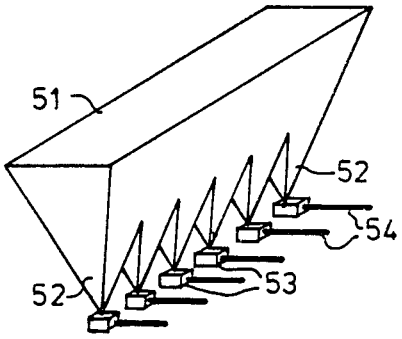

FIG. 8 illustrate a modified form of hopper here indicated at 51, which is arranged with six lower conical portions 52 each feeding a venturi 53 and a flexible feed line 54, for conveying material to be sprayed to a lance for example of the type shown in FIG. 5. Each such feed line 54 could be connected to a feed passage 21 as shown in that Figure.

We claim:

1. A lance for spraying particulate refractory-forming combustible material, particulate refractory material and a comburent gas, comprising:

means defining at least one feed passage for conveying material to be sprayed; and a lance head which has a stem and is operatively connected to said at least one feed passage, and which includes a plurality of spray nozzles for spraying the material, means defining a flow path for flow of the material being sprayed along said flow path from an upstream to a downstream position, said flow path being formed to have a location at which the material undergoes a change in direction as it flows along the flow path, means providing a cup-like recess located at said location, said recess being open to the flow path in the upstream direction of said flow path, for catching particulate material conveyed along said flow path so that the material caught itself forms a barrier against abrasion at the location of the recess, and a cooling jacket provided for said stem, wherein there are a plurality of feed passages each feeding a said spray nozzle.

2. A lance for spraying particulate refractory-forming combustible material, particulate refractory material and a comburent gas, comprising:

means defining at least one feed passage for conveying material to be sprayed; and a lance head which has a stem and is operatively connected to said at least one feed passage, and which includes a plurality of spray nozzles for spraying the material, means defining a flow path for flow of the material being sprayed along said flow path from an upstream to a downstream position, said flow path being formed to have a location at which the material undergoes a change in direction as it flows along the flow path, means providing a cup-like recess located at said location, said recess being open to the flow path in the upstream direction of said flow path, for catching particulate material conveyed along said flow path so that the material caught itself forms a barrier against abrasion at the location of the recess, and a cooling jacket provided for said stem, wherein the nozzles have axes that are substantially parallel.

3. A lance according to claim 2, wherein said lance has an axis and wherein said spray nozzles are disposed with their axes at an angle to the axis of said lance.

4. A method of spraying particulate refractory-forming combustible material, particulate refractory material and a comburent gas against a surface so that on combustion a coherent refractory mass is formed on such surface, comprising: using a lance having a lance head with a plurality of spray nozzles and having at least one feed passage along which the material to be sprayed is conveyed to said lance head whence the material is ejected through said plurality of spray nozzles, said material moving through said lance head along a flow path from an upstream to an downstream position; controlling said flow path to provide at least one location at which the material undergoes a change in direction as it flows along the flow path; and catching particulate material conveyed along said flow path by locating a cup-like recess at each said at least one location so that the material caught itself forms a barrier against abrasion at the location of said recess.

5. A method according to claim 4 wherein the step of controlling the flow path further comprises conveying said material to be sprayed to all said spray nozzles via at least one common feed passage.

6. A method according to claim 5, wherein the flow path of the material being sprayed undergoes an abrupt change of direction in the lance head, and wherein the step of catching is accomplished by receiving said particulate material conveyed along the flow path in at least one cup member so that the material caught itself forms a barrier against abrasion at the location of such change of direction.

7. A method according to claim 4, wherein there are a plurality of feed passages and whrein the step of using the lance comprises conveying said particulate material to be sprayed toward each said nozzle along a different feed passage.

8. A method according to claim 4, wherein the lance head has a centre and the nozzles have ends, and further comprising differentially spacing the ends of the nozzles from the centre of the lance head.

9. A method according to claim 4, wherein the step of using the lance is conducted by spraying the material in streams having substantially parallel axes.

10. A method according to claim 9, wherein the lance has an axis and the axes of the streams lie at an angle to the axis of the lance.

11. A method according to claim 4, wherein the step of using the lance is conducted by spraying the material in streams which have a common axis of symmetry.

12. A method according to claim 4, further comprising cooling the lance during spraying.

13. A method according to claim 4, wherein the step of using the lance is conducted by spraying the material from at least three spray nozzles.

14. A method according to claim 4, further comprising feeding the particulate material to said at least one feed passage of the lance via a venturi for each said at least one feed passage along which particulate material is conveyed.

15. A method according to claim 4, further comprising feeding said combustible material and said refractory material to the lance from a common hopper.

16. A method according to claim 4, further comprising feeding the lance refractory particles which constitute at least 80% by weight of the particulate material sprayed.

17. A lance for spraying particulate refractory-forming combustible material, particulate refractory material and a comburent gas, comprising:

means defining at least one feed passage for conveying material to be sprayed; and a lance head which has a centre and is operatively connected to said at least one feed passage, and which includes a plurality of spray nozzles for spraying the material, said spray nozzles having ends which are differentially spaced from said centre of said lance head, means defining a flow path for flow of the material being sprayed along said flow path from an upstream to a downstream position, said flow path being formed to have a location at which the material undergoes a change in direction as it flows along the flow path, and means providing a cup-like recess located at said location, said recess being open to the flow path in the upstream direction of said flow path, for catching particulate material conveyed along said flow path so that the material caught itself forms a barrier against abrasion at the location of the recess.

18. A lance for spraying particulate refractory-forming combustible material, particulate refractory material and a comburent gas, comprising:

means defining at least one feed passage for conveying material to be sprayed; and a lance head which has a stem and is operatively connected to said at least one feed passage, and which includes a plurality of spray nozzles for spraying the material, means defining a flow path for flow of the material being sprayed along said flow path from an upstream to a downstream position, said flow path being formed to have a location at which the material undergoes a change in direction as it flows along the flow path, means providing a cup-like recess located at said location, said recess being open to the flow path in the upstream direction of said flow path, for catching particulate material conveyed along said flow path so that the material caught itself forms a barrier against abrasion at the location of the recess, and a cooling jacket provided for said stem, wherein there is at least one said feed passage feeding all said spray nozzles, wherein said spray nozzles are disposed out of register with said at least one feed passage, and wherein said means providing a cup-like recess includes a cup member in line with and open to said at least one feed passage.

19. A lance according to claim 18, wherein said lance head has a centre and an axis through its centre and is symmetrical about the axis through its centre.

20. A lance according to claim 18, wherein said cooling jacket is a contra-flow cooling jacket.

21. A lance according to claim 20, wherein said cooling jacket comprises at least three concentric coolant passages arranged for coolant flow in alternate directions as between one such passage and the next.

22. A lance according to claim 18, wherein said lance head includes at least three said spray nozzles.

23. Spraying apparatus including a lance according to claim 18, at least one venturi associated with said at least one feed passage, and means for feeding the particulate material to said at least one feed passage of said lance via said at least one venturi

24. Spraying apparatus according to claim 23, and further comprising a single hopper for feeding particulate material to said at least one feed passage.

* * * * *